US008607983B2

(12) United States Patent
Niven et al.

(10) Patent No.: US 8,607,983 B2
(45) Date of Patent: Dec. 17, 2013

(54) PACKAGING SYSTEM

(75) Inventors: Norman Niven, Stockport (GB); John Niven, Stockport (GB)

(73) Assignee: Protomed Limited (GB)

( * ) Notice: Subject to any disclaimer, the term of this patent is extended or adjusted under 35 U.S.C. 154(b) by 466 days.

(21) Appl. No.: 12/682,524

(22) PCT Filed: Oct. 8, 2008

(86) PCT No.: PCT/GB2008/050922

§ 371 (c)(1),
(2), (4) Date: Apr. 16, 2010

(87) PCT Pub. No.: WO2009/047560

PCT Pub. Date: Apr. 16, 2009

(65) Prior Publication Data

US 2010/0236960 A1 Sep. 23, 2010

(30) Foreign Application Priority Data

Oct. 12, 2007 (GB) ..... 0719991.2

(51) Int. Cl.
*B65D 51/00* (2006.01)
*B65D 1/34* (2006.01)

(52) U.S. Cl.
USPC ..... 206/538; 206/559; 206/562

(58) Field of Classification Search
USPC ..... 206/459.1, 459.5, 561, 538, 562, 559; 215/232
See application file for complete search history.

(56) References Cited

U.S. PATENT DOCUMENTS 3,608,770 A * 9/1971 Naimoli ..... 220/575
3,844,408 A * 10/1974 Relyea ..... 206/534
3,983,999 A * 10/1976 Morton ..... 229/120.011
4,735,318 A 4/1988 Keffeler (Continued)

FOREIGN PATENT DOCUMENTS

AU 762923 B2 7/2003
GB 1593214 7/1981

(Continued)

OTHER PUBLICATIONS

UK Intellectual Property Office Search Report, Nov. 9, 2007.

(Continued)

*Primary Examiner* — Steven A. Reynolds
*Assistant Examiner* — Ernesto Grano
(74) *Attorney, Agent, or Firm* — Knobbe, Martens, Olson & Bear, LLP

(57) ABSTRACT

A system for discretely packaging liquid or solid medication, or other substances, comprising a tray (10) with individual compartments (12) each containing a removable pot (17) and a perforated sealed sheet (21) enabling individual pots to be removed from the tray (10) for dispensing of its contents. The system also includes a computer and printer with software to create printed matter for the sheet (21) representative of the contents of the individual pots (17). An outer container (24) may receive several such filled and sealed trays (10) and an information sheet (28). One or more windows (30) in the container (24) provide a visual display of the contents. The system enables safe, accurate and easy packaging and dispensing of medication or other substances.

10 Claims, 7 Drawing Sheets

(56) References Cited

U.S. PATENT DOCUMENTS

| | | | | |
|---|---|---|---|---|
| 4,966,296 | A | 10/1990 | Farrell | |
| 5,046,609 | A * | 9/1991 | Mangini et al. | 206/232 |
| 5,788,079 | A * | 8/1998 | Bouthiette | 206/534 |
| 5,904,263 | A * | 5/1999 | St. Pierre et al. | 220/23.4 |
| 6,527,123 | B1 * | 3/2003 | Ausaf | 206/549 |
| 6,595,365 | B1 * | 7/2003 | Wigmore | 206/538 |
| 6,981,592 | B2 * | 1/2006 | Siegel | 206/538 |
| 7,055,294 | B1 * | 6/2006 | Lewis | 53/411 |
| 7,828,149 | B2 * | 11/2010 | Kalvelage et al. | 206/538 |
| 2012/0060450 | A1 * | 3/2012 | Burns et al. | 53/467 |

FOREIGN PATENT DOCUMENTS

| | | | |
|---|---|---|---|
| GB | 2292134 | A | 2/1996 |
| WO | WO 90/11035 | | 10/1990 |
| WO | WO 02/092439 | A3 | 11/2002 |
| WO | WO 2006/079192 | | 8/2006 |
| WO | WO 2007/106901 | | 9/2007 |

OTHER PUBLICATIONS

International Search Report (ISA—EPO), Mar. 18, 2009.

* cited by examiner

PACKAGING SYSTEM

RELATED APPLICATIONS

The present application is the U.S. National Phase under 35 U.S.C. §371 of International Application PCT/GB2008/050922, filed Oct. 8, 2008, which claims priority under 35 U.S.C. §119(a) and §365(b) to Great Britain Patent Application No. GB 0719991.2, filed Oct. 12, 2007.

This invention relates to a system for discretely packaging a plurality of quantities of one or more fluid or solid substances.

Particularly, though not exclusively, the system has been devised to meet the needs of patients and carers in the safe, accurate and convenient monitored dispensing of medication both in liquid and solid forms. Liquid medication, apart from the use of individual sachets or blisters, is currently supplied to the patient or carer in large containers from which individual doses are dispensed, usually into a measuring spoon or cup from which the patient takes the medicine.

It is of the utmost importance that a patient should take an accurate dose of the correct medicine and that there should be no risk of confusion or of cross-contamination between patients should a large bottle of medication be used, perhaps improperly, to dispense the medication to different patients.

Conventionally, and particularly in care homes, it is necessary for large numbers of such bottles to be stored, and this takes up considerable space. Furthermore, since the medication is contained in a large bottle then as the quantity in the bottle diminishes an increasing air space above the liquid is created which can adversely affect the chemical properties of the medicine.

It is an object of the present invention to provide a system of accurately and conveniently packaging individual doses of medication, whether in liquid or tablet form, and which is more easily managed in a safe and convenient manner, thus substantially avoiding the aforementioned difficulties.

According to one aspect of the present invention there is provided a container for discretely packaging a plurality of quantities of one or more fluid or solid substances, and comprising a tray having individual spaced compartments, a plurality of vessels individually removably received within the respective compartments and adapted to contain the substances to be packaged, means releasably to retain the vessels in the compartments prior to intended release, and means sealingly to retain the substances in the vessels prior to their intended use.

The compartments may be pre-formed integrally with the tray.

The vessels may be individual pots.

The vessels and the compartments may be of complementary shape and size.

The means to retain the substances in the vessels may comprise a flexible sheet sealingly attached to and across an otherwise open top of each vessel.

The means releasably to retain the vessels in the compartments may be a single flexible sheet sealingly attached to and across the tray and all the vessels therein with perforations to permit selective removal of the vessels individually while at least some of the vessels are retained and remain sealingly closed.

The flexible sheet may display printed matter identifying the content of each vessel.

The flexible sheet may display printed matter identifying the content of all of the vessels and the purpose for, or manner in which, the contents are to be used.

Each compartment may have an aperture in a base region thereof to enable the associated retained vessel to be pushed out of its compartment.

The flexible sheet attached across each vessel may be loosely superimposed upon a part of an upper surface of the associated vessel thus, after removal of the vessel from the tray, to allow the sheet to be peeled off to open the vessel to dispense the contents therefrom.

A peripheral flange may be provided around the top of each vessel, a part of which is readily deformable to assist in peeling off the sheet to open the vessel.

According to a further aspect of the invention there is provided a system for discretely packaging a plurality of quantities of one or more fluid or solid substances, the system comprising a container, as aforesaid, in combination with a computer and printer for designing and printing a perforated sheet displaying information relating to the substances to be packaged and a device adapted automatically to apply a printed perforated sheet to the container to close and seal the vessels.

The system may also include software to display on a computer screen an image of a container as aforesaid and to enable an image representative of a substance to be packaged to be displayed on or adjacent an image of an individual vessel within the container.

The software may display the substance by drag and drop from a list of substances in text form displayed alongside the container image on the screen.

The software may be adapted to convert the display of an image of the substance on the screen into text to be printed on the sheet.

The software may be adapted to produce an image on the screen of a set of data representative of the intended use of the substances to be packaged, such as a date by which a packaged substance should be used.

The system may include an outer container for transportation, adapted to receive a plurality of the aforesaid containers in superimposed relationship with spaced dividing members whereby the aforesaid containers may be housed within the outer container in the manner of drawers.

Embodiments of the invention will be now be described, by way of example only, with reference to the accompanying drawings, in which.

The following description, by way of example, is of a system for discretely packaging a plurality of quantities of medication in liquid, tablet or capsule form. Equally, the system may be used for packaging individual quantities of any substance to be dispensed as required. Thus, the system may be used for packaging small quantities of foodstuffs. However, its principal intention is to produce a monitored dosing system for medication where both the patient and the dispensing personnel can be certain that the medication is correctly and safely prepared and taken. Such a system is for the benefit of not only patients and carers but also of pharmacists.

Figure 1:
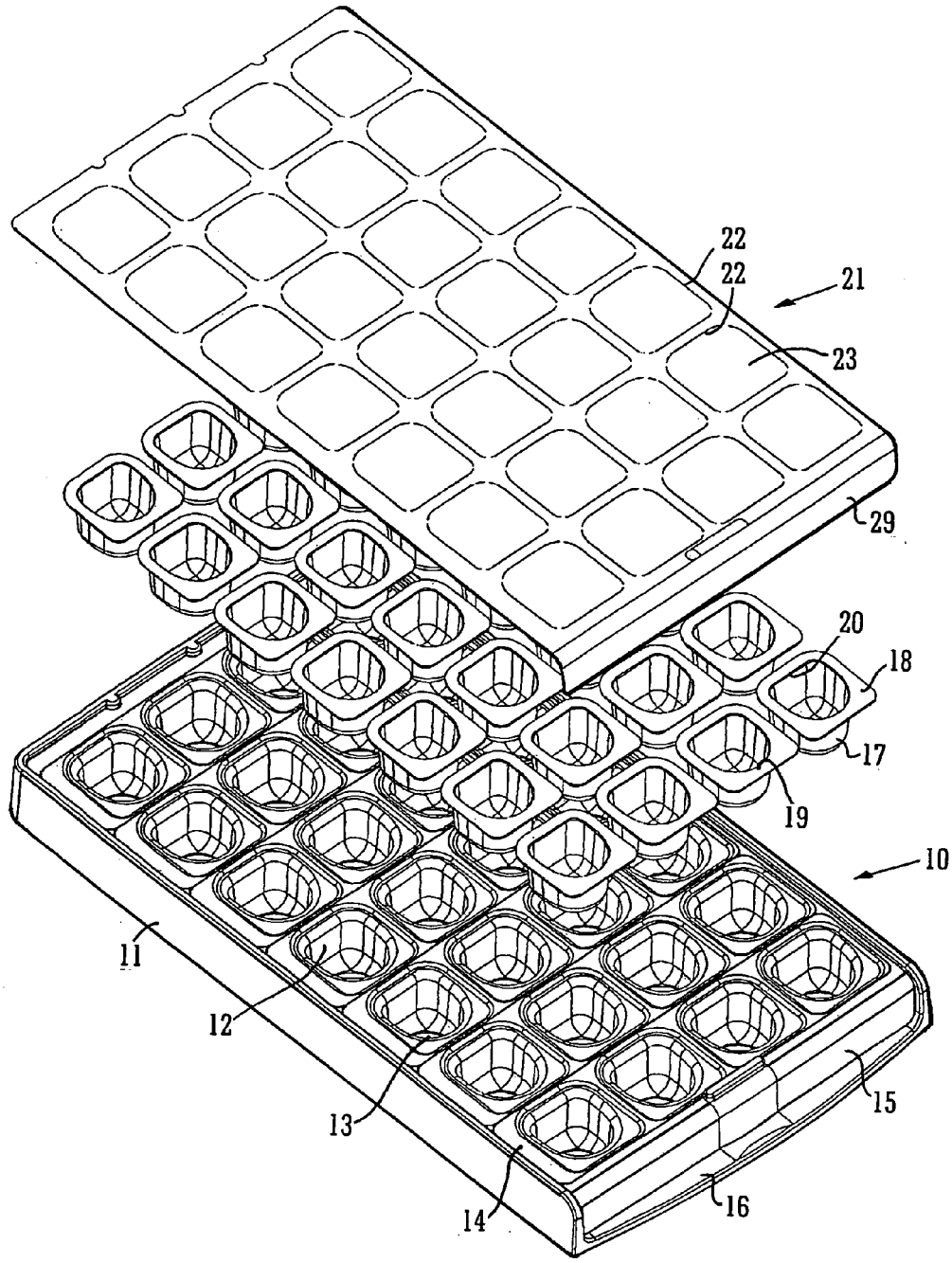
FIG. 1 is an exploded perspective view of a container made in accordance with the invention.
Figure 2:
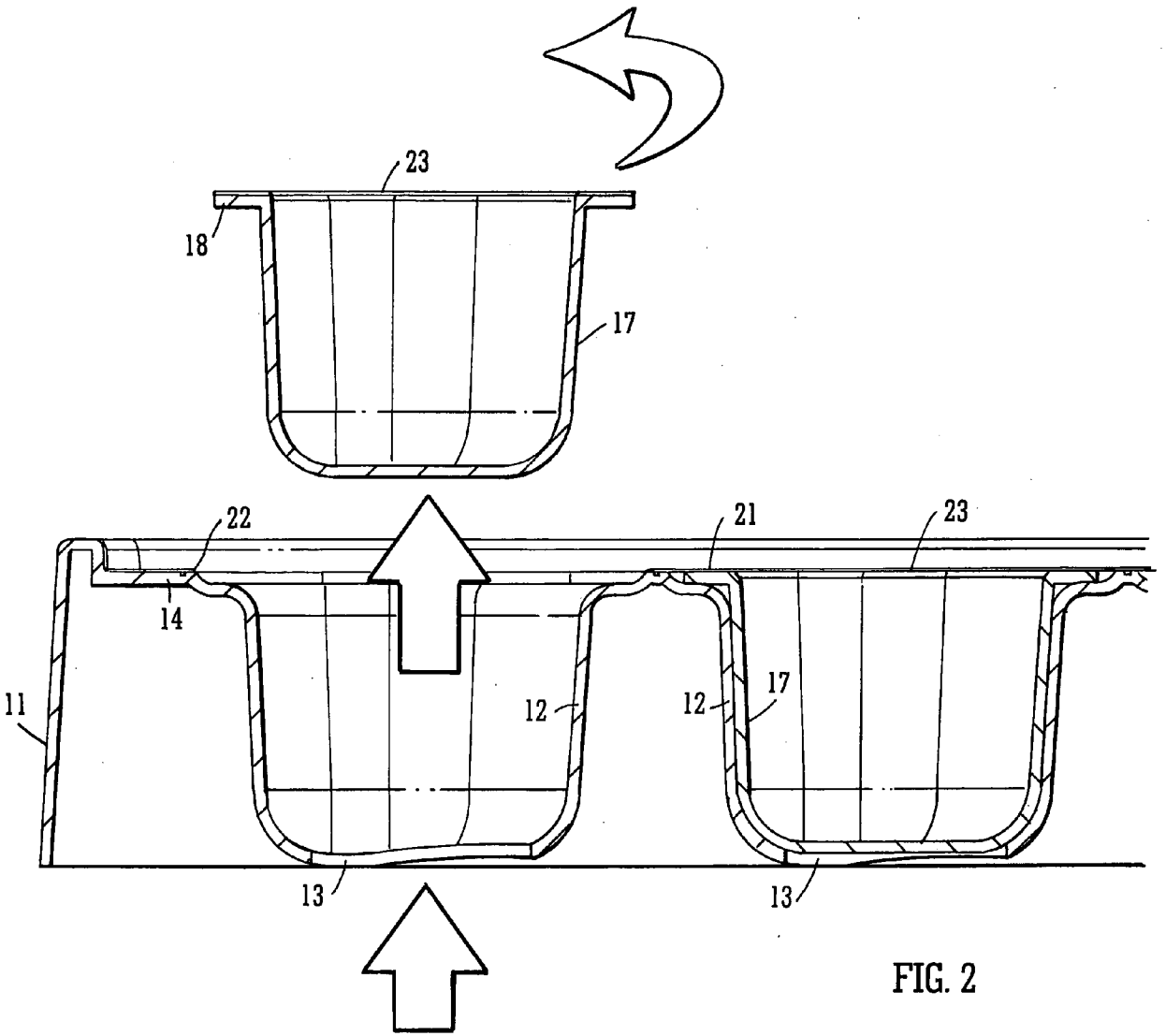
FIG. 2 is an enlarged cross-sectional view of part of the container of FIG. 1.

Referring now to FIGS. 1 and 2, a container made in accordance with the invention comprises a tray generally indicated at 10, of a plastics material and formed to define side walls 11 and an array of individual preformed, side-by-side compartments 12 each having an opening 13 at its base and a common upper platform 14 extending across the tray 10 between the compartments 12. A front wall 15 provides a surface for the display of data concerning the contents of the tray and a lip 16 enables the tray to be withdrawn from an outer container to be described.

Located within each compartment 12 is a vessel in the form of an individual pot 17 for containment of a substance to be packaged. Each pot 17 has an upper flange 18 which when the pot is located in the tray rests upon, and flush with, the platform 14. The pots may be of the same material as the tray 11, and are preferably transparent.

The shape of the recess defined within each pot 17 is such as to have a curved upper rim 19 at least at one side. Opposite the curved rim 19 in each pot is a straight end 20. The walls of each pot also conform to the shape of the upper rim.

For preference, each pot 17 is of such a size as to be an interference fit within its compartment which is of complementary shape and size.

With all of the pots 17 in place a pharmacist may place the appropriate medication in each pot either by using a measured pipette for liquid medication or by placing tablets or capsules into the pots for solid medication.

To complete the container a flexible sheet 21 of a non-permeable material having perforations 22 is placed over the filled tray and sealed, as will be described. The perforations 22 coincide with the outer peripheries of the pots 17, thus to define individual sealed films 23, one across each pot. The sheet 21 is adhesively sealed to the platform 14 and around each individual pot flange 18.

With the sheet in place the pots can be removed individually by pushing a pot upwards through the opening 13 in the associated compartment thus breaking the perforation in the sheet 21, while maintaining the integrity of the sealed film 23. This action is shown in FIG. 2 and it can be seen that once the pot is removed, the sealed film 23 remaining on the flange 18 can be peeled off to open the pot whereupon the medication can be taken.

The curved rim 19 of each pot facilitates the taking of liquid medication. The regions of the flange 18 either side of the curved rim will have sufficient flexibility that they can be deformed to assist in release of the individual sealed film 23.

In this manner, therefore, individual pots can be removed whilst the remainder are retained and sealed on the tray 10. The individual films 23 may be printed, for example, with a time and date and the contents of the associated pot. A front flap 29 of the sheet 21 can be printed with information pertaining to the contents of the entire tray.

To avoid any risk of contamination it is intended that the entire tray 10 be disposable.

Figure 3:
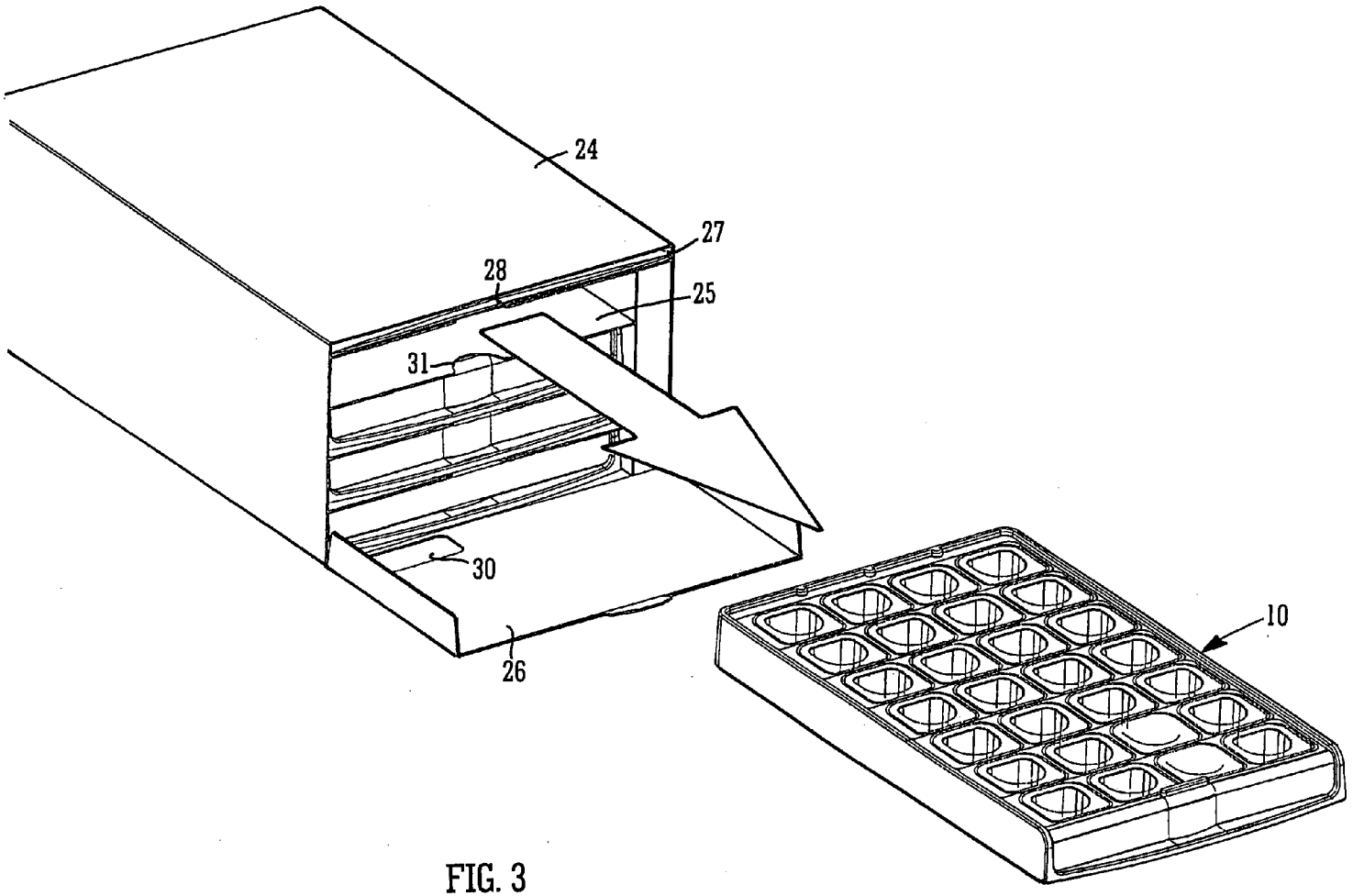
FIG. 3 is a perspective view of a container being part of a system in accordance with the invention.

Referring now to FIG. 3, there is illustrated a patient pack comprising an outer container 24 having superimposed internal dividing members 25 to enable a plurality of trays 10 to be stacked in superimposed relationship within the container 24 which may then be closed and sealed by way of a lid 26. Also within the container 24 is a shallow compartment 27 which is adapted to receive a data sheet 28 with details of the patient and the contained medication. Since the front flap 29 of the sheet 21 will contain information concerning the contained medication and perhaps the patient's name, a window 30 in the lid 26 will enable the information on the flap 29 of the sheet to be read. In a multi-container pack as illustrated several windows 30 may be provided in the lid 26 in order to make the information visible on each of the trays contained within the pack.

The lip 16 on each tray, together with a recess 31 on each dividing member 25, facilitates removal of a tray from the pack.

Figure 4:
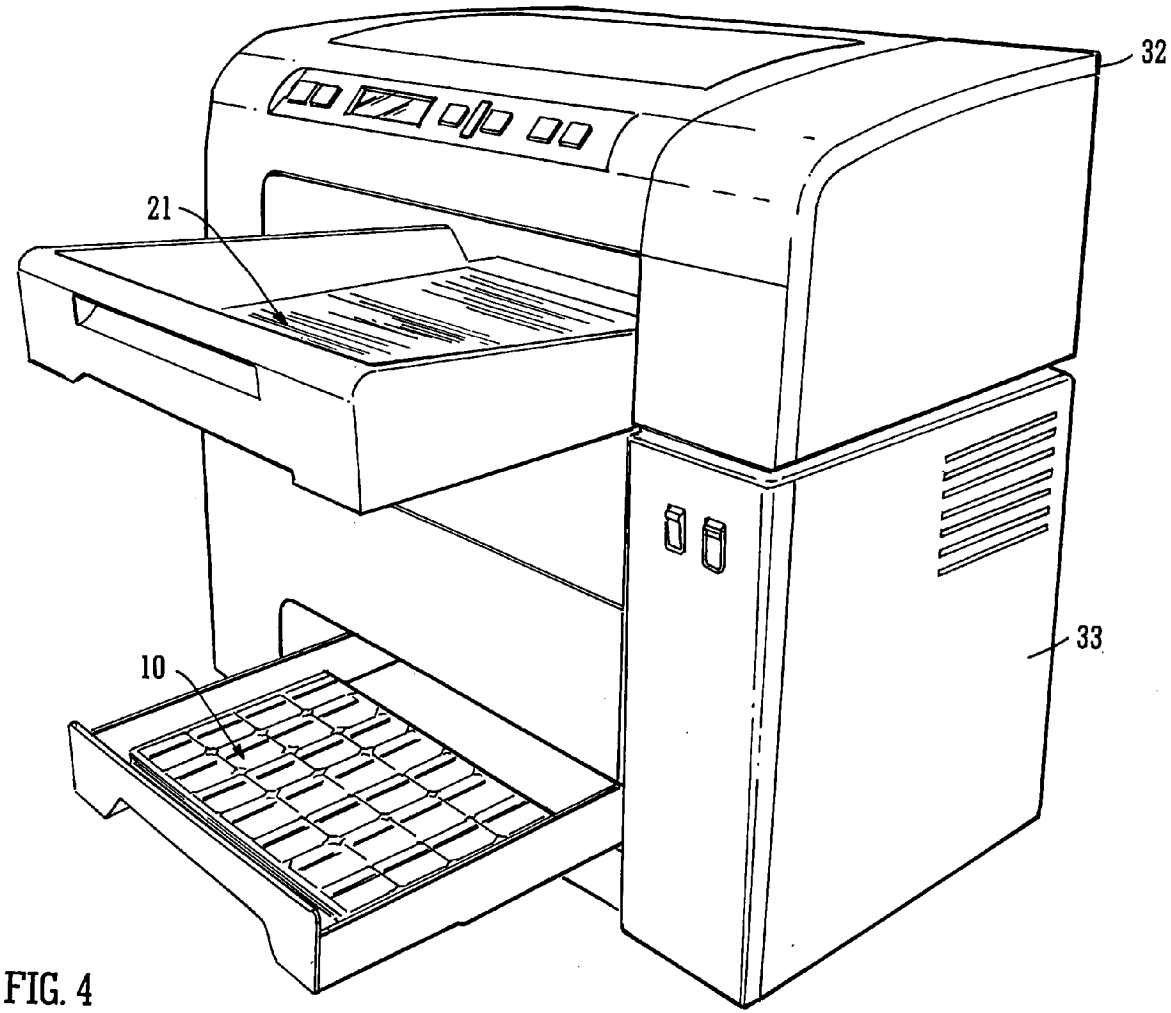
FIG. 4 illustrates a combined printer and labelling machine being a part of the system in accordance with the invention.

Referring now to FIG. 4, the system may include, for use by the pharmacist, a combined printer 32 and labelling device 33.

The system may also include a computer with software to be described, which commands the printer 32 to print the perforated sheet 21 which is then heat-sealed onto the filled tray within the labelling device 33.

Figure 5:
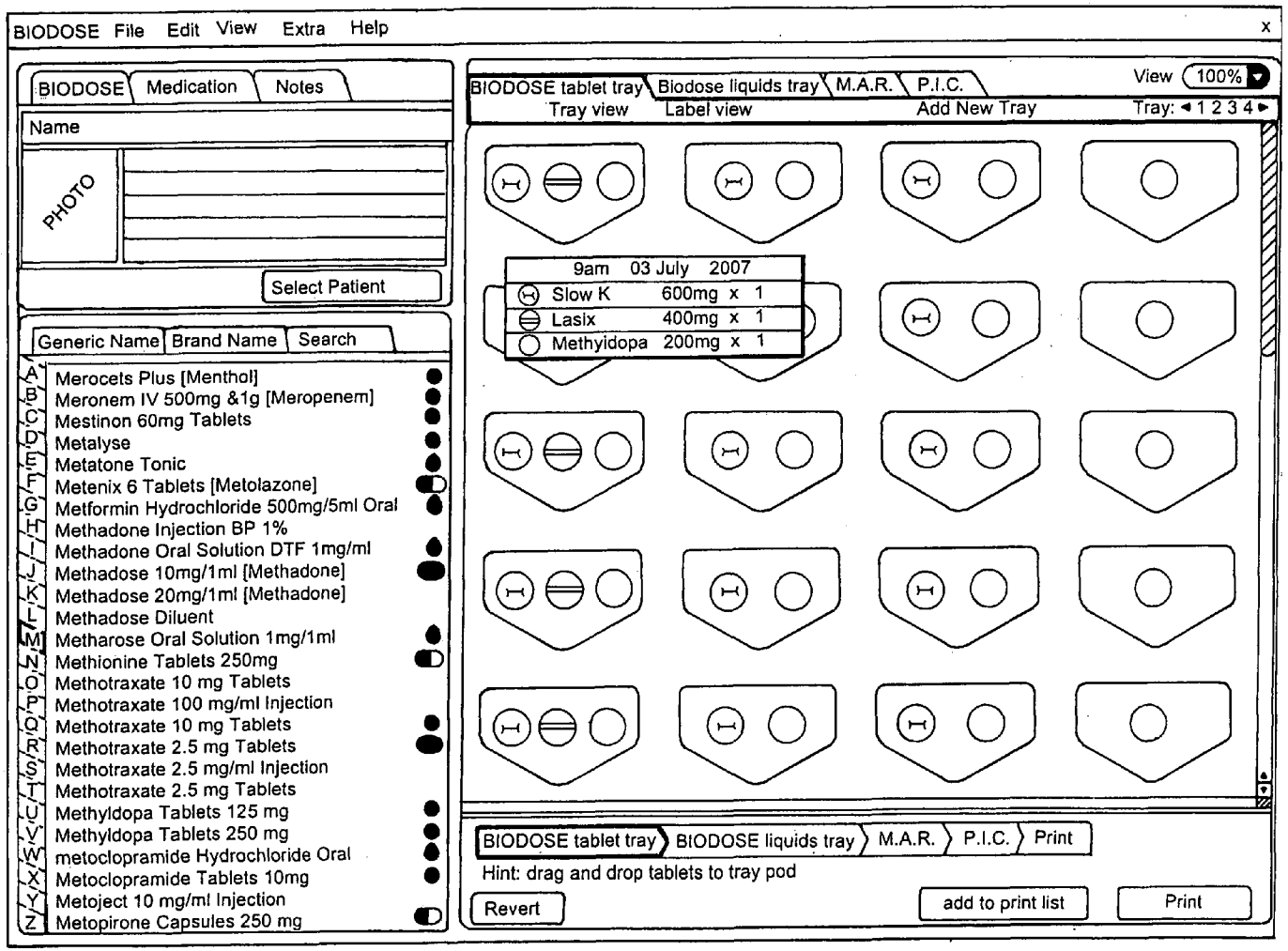
FIG. 5 illustrates a screen shot produced by software being part of the system according to the invention.

Referring now to FIG. 5, the computer software within the system may be adapted to produce images on screen to enable the pharmacist to select medication for a particular patient and then to print the relevant data, via the printer 32, onto the sheet 21 for attachment to the tray. FIG. 5 shows a screen shot enabling a pharmacist, by the drag and drop principle, to select medication from a list in text form on the left hand side of the screen and to transfer the or each item of medication to one or more images on the right hand side of the screen representing compartments within the tray 10. Colour coding of tablets and capsules will be adopted to enable the pharmacist to see at a glance that the correct medication has been selected for each pot within the tray and the software will further illustrate, for each compartment, and if necessary for each separate tablet, the time and date when the tablet should be taken and the milligram dosage of the particular tablet. If liquids are being dispensed then again an image will appear on the screen in the respective compartments representing the liquid or liquids to be taken. The patient's details, preferably including a photograph, will also be illustrated on the screen to provide a check that the correct medication is being dispensed for that patient.

Figure 6:
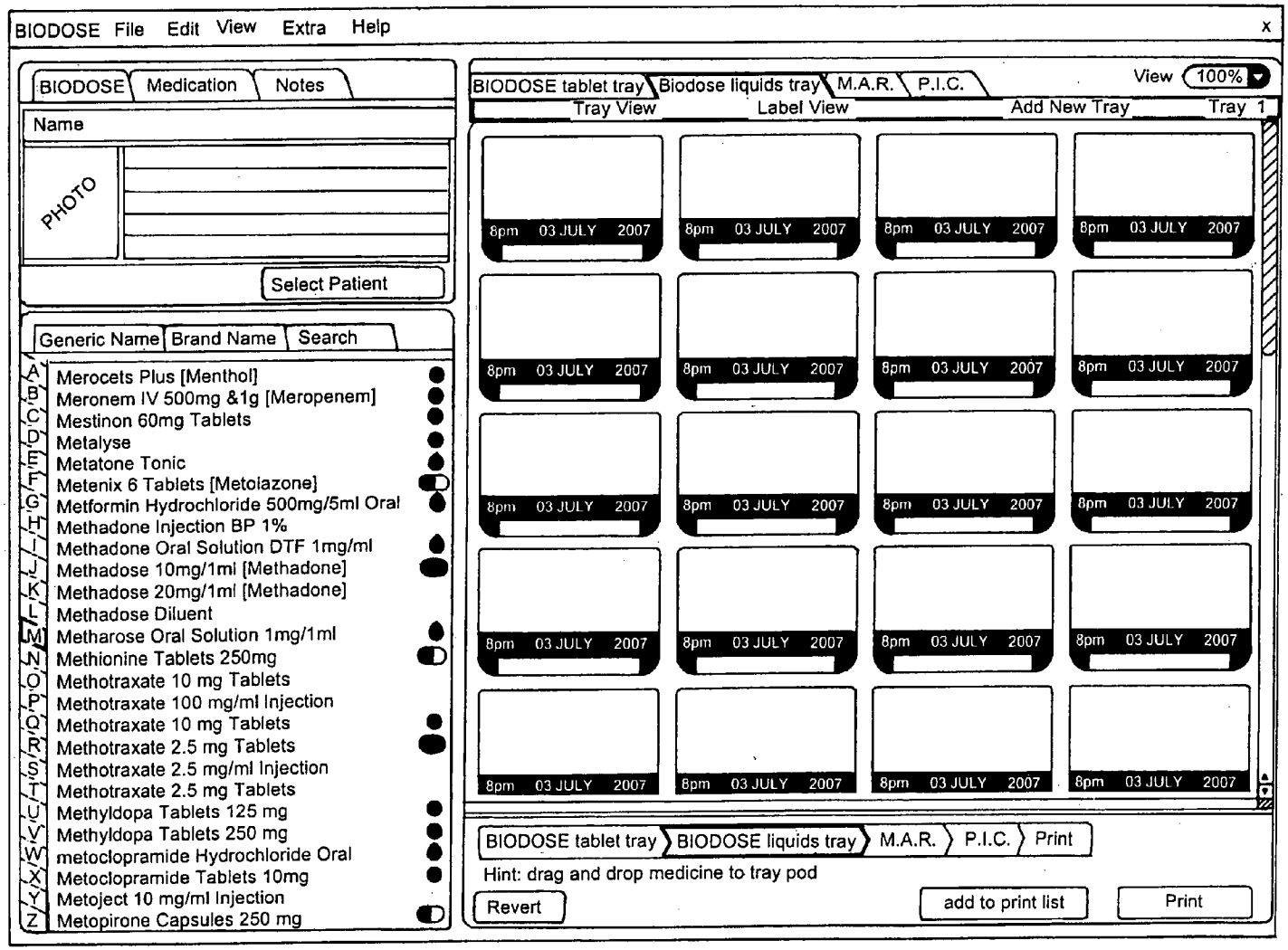
FIG. 6 is a further screen shot.

Referring now to FIG. 6, in a subsequent step the right hand side of the screen, again representing positions of individual pots within the tray, will illustrate textual information concerning the content and dosing for each individual compartment and the name of the patient. In this way, should an individual pot be removed from the tray and become separated from it, the patient's details and the dosage are clearly visible on the top of the pot from which the film 23 can be removed just prior to medication being taken.

Figure 7:
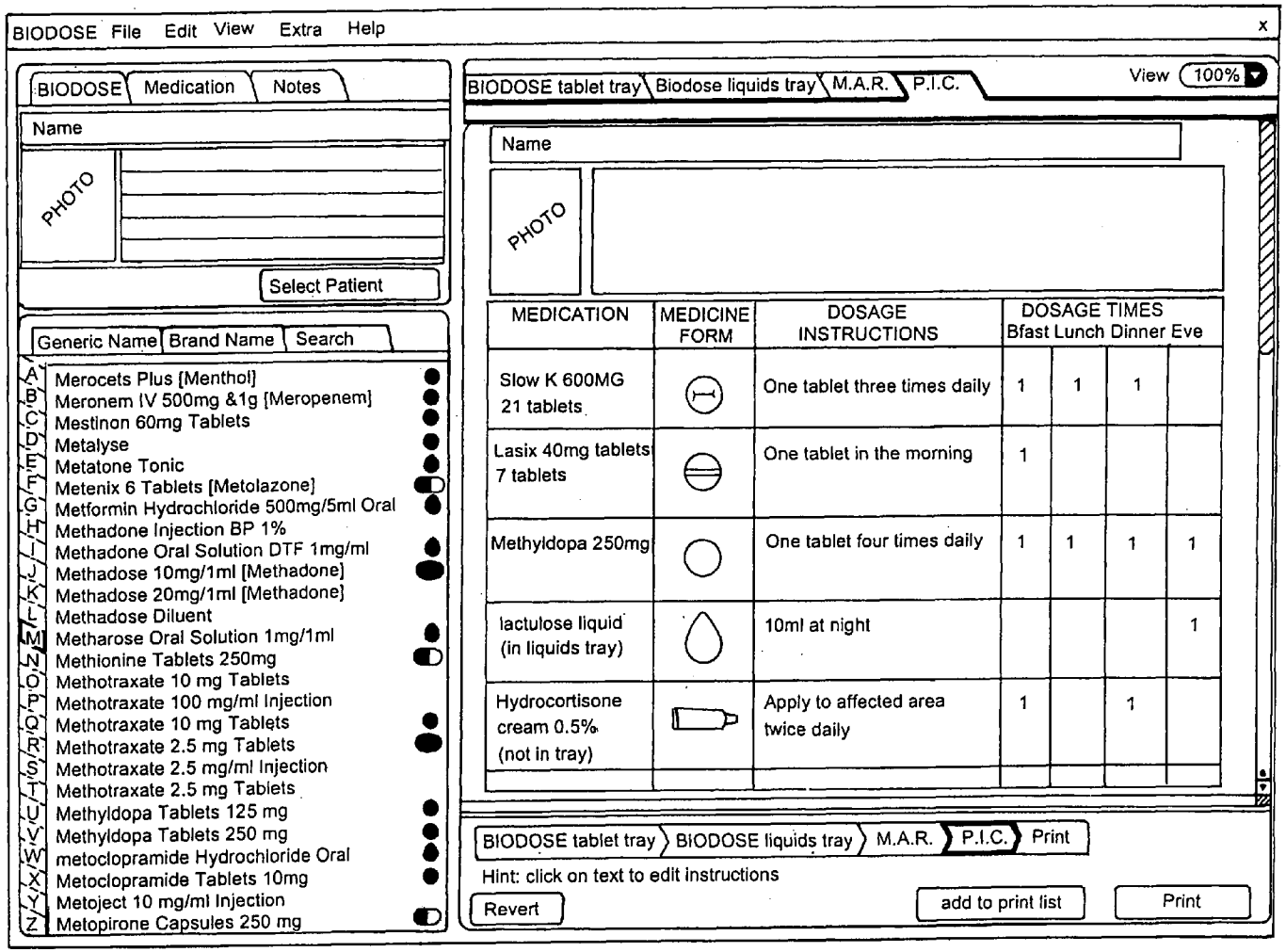
FIG. 7 is a further screen shot.

Referring now to FIG. 7, the software can also be used to print the data sheet 28 to be enclosed within the patient pack. This is illustrated at the right hand side of the screen in FIG. 7 and provides information concerning all of the medication and the dosage requirement appertaining to that patient and that pack. Still further sheets may be printed to provide a medication administration report, for example that a particular patient has taken the appropriate medication at the appropriate time, and again the software will enable the production of a screen image for this purpose which will be transferred onto an appropriate data sheet. The design and printing of this data by the computer and the printer 32 greatly facilitates the pharmacist's procedure in producing the packaged medication and further ensures the correct medication is made available for the patient.

The only manual operation still remaining for the pharmacist is the placing of the medication in each of the pots 17 prior to application of the sheet 21. A measured pipette typically would be used for dispensing liquid medication while pill dispensers or the like may be used for placing tablets and capsules in the pots.

The pots 17 may be made available in a number of typical dose sizes such as 10 mm, 15 mm and 30 mm. Preferably they should be sized at least to ensure that they pass the "choke" test for such products. The material selected for the pots will be such as to be substantially transparent while protecting the contents from the effects of UV light.

It will be seen that the tray 11 has a raised edge portion such that multiple trays may be stacked in superimposed relationship if required.

A number of important advantages accrue from a system in accordance with the invention.

For example, each tray may be charged with substances of different kinds such as tablets, capsules and liquids or ointments, a feature which has not hitherto been possible with blister packaging or the like.

Also, the pots with the removable film 23 avoid the conventional problem, with foil covered blisters, of having to eject tablets or capsules by applying sufficient force to eject them through the foil, often resulting in lost or spoiled medication.

Additionally, the pot serves as a medicine cup in itself, thus avoiding the need for foil packed tablets or capsules to be pre-dispensed into a medicine cup.

The sealing process is less likely to damage or contaminate the medication which, in the pot, is separated from the sealing source to a much greater extent than with blister packaging.

The individual pots can be removed selectively to allow medication to be removed from the tray and taken away by the patient for use elsewhere and at a later time.

The invention claimed is:

1. A monitored dosing system container for discretely packaging a plurality of quantities of one or more fluid or solid medications, comprising:

a tray having individual spaced compartments and an upper platform extending across the tray between the compartments, a plurality of pots individually removably received within the respective compartments, wherein each pot has an upper flange and is adapted to contain a medication to be packaged, means to releasably retain the pots in the compartments prior to intended release, and means to sealingly retain the medication in the pots prior to its intended use, wherein the means to sealingly retain the medication in the pots comprises a flexible perforated sheet of non-permeable material placed over the filled tray and sealingly attached to and across an otherwise open top of each pot, wherein the sheet is sealed to the upper platform and around each individual pot flange, and wherein the perforations of the sheet coincide with the outer peripheries of the pots so as to define individual sealed films across each pot, such that once the pot is removed the sealed film can be peeled off the upper flange to open the pot.

2. A container according to claim 1, wherein the compartments are preformed integrally with the tray.

3. A container according to claim 1, wherein the pots and the compartments are of complementary shape and size.

4. A container according to claim 1, wherein the sheet is a single flexible sheet sealingly attached to and across the tray and all of the pots therein with perforations to permit selective removal of the pots individually while at least some of the pots are retained and remain sealingly closed.

5. A container according to claim 4, wherein the flexible sheet displays printed matter identifying the content of each pot.

6. A container according to claim 4, wherein the flexible sheet displays printed matter identifying the content of all of the pots and the purpose for, or manner in which, the contents are to be used.

7. A container according to claim 1, wherein each compartment has an aperture in a base region thereof to enable the associated retained pot to be pushed out of its compartment.

8. A container according to claim 4, wherein the flexible sheet attached across each pot is loosely superimposed upon a part of an upper surface of the associated pot thus, after removal of the pot from the tray, to allow the sheet to be peeled off to open the pot to dispense the contents therefrom.

9. A container according to claim 4, including a peripheral flange provided around the top of each pot, a part of which is readily deformable to assist in peeling off the flexible sheet to open the pot.

10. A container according to claim 1, wherein the one or more fluid or solid medications include a liquid medication.

* * * * *